US007187340B2

(12) United States Patent
Kralovec et al.

(10) Patent No.: US 7,187,340 B2
(45) Date of Patent: Mar. 6, 2007

(54) SIMULTANEOUS MULTI-BAND RING FOCUS REFLECTOR ANTENNA-BROADBAND FEED

(75) Inventors: Jay Kralovec, Viera, FL (US); Griffin Gothard, Satellite Beach, FL (US); Sean Ortiz, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 19 days.

(21) Appl. No.: 10/966,092

(22) Filed: Oct. 15, 2004

(65) Prior Publication Data

US 2006/0082513 A1 Apr. 20, 2006

(51) Int. Cl.
*H01Q 13/00* (2006.01)

(52) U.S. Cl. ..... 343/781 CA; 343/781 P

(58) Field of Classification Search ..... 343/776, 343/786, 781, 779, 761
See application file for complete search history.

(56) References Cited

U.S. PATENT DOCUMENTS

| | | | | | |
|---|---|---|---|---|---|
| 3,714,652 | A | | 1/1973 | Grabowski et al. | |
| 4,644,362 | A | * | 2/1987 | Rammos | 343/778 |
| 4,811,028 | A | * | 3/1989 | Bryanos | 343/786 |
| 4,829,314 | A | * | 5/1989 | Barbier et al. | 343/778 |
| 4,878,061 | A | | 10/1989 | Nusair et al. | |
| 5,471,664 | A | * | 11/1995 | Kim | 455/323 |
| 5,552,797 | A | * | 9/1996 | Cook | 343/786 |
| 5,580,387 | A | | 12/1996 | Chen | |
| 5,737,698 | A | * | 4/1998 | Gabrelian et al. | 455/286 |
| 5,973,654 | A | * | 10/1999 | Lusignan et al. | 343/786 |
| 6,111,547 | A | * | 8/2000 | Gau et al. | 343/786 |
| 6,211,834 | B1 | * | 4/2001 | Durham et al. | 343/781 P |
| 6,271,799 | B1 | * | 8/2001 | Rief et al. | 343/776 |
| 6,489,931 | B2 | | 12/2002 | Liu | |
| 6,603,438 | B2 | | 8/2003 | Strickland | |
| 6,624,792 | B1 | * | 9/2003 | Chu et al. | 343/786 |
| 6,697,028 | B1 | | 2/2004 | Gothard et al. | |
| 6,831,613 | B1 | * | 12/2004 | Gothard et al. | 343/779 |
| 2003/0210197 | A1 | * | 11/2003 | Cencich et al. | 343/786 |

OTHER PUBLICATIONS

U.S. Appl. No. 10/600,627, filed Jun. 20, 2003, Gothard, et al.
U.S. Appl. No. 10/694,469, filed Oct. 27, 2003, Kralovec, et al.
U.S. Appl. No. 10/703,257, filed Nov. 7, 2003, Gothard, et al.
U.S. Appl. No. 10/703,253, filed Nov. 7, 2003, Gothard, et al.

* cited by examiner

*Primary Examiner*—Alford Kindred
*Assistant Examiner*—Hung Tran Vy
(74) *Attorney, Agent, or Firm*—Sacco & Associates, PA; Robert J. Sacco

(57) ABSTRACT

Compact multi-band antenna system (500) includes a main reflector (502) having a shaped surface of revolution about a boresight axis of the antenna operable at a plurality of frequency bands spectrally offset from each other. A multi band feed system (300) is provided for the main reflector that includes a subreflector (304) formed as a shaped surface of revolution about the boresight axis of the antenna, and a horn antenna (302). The horn antenna has one or more ridges (312) disposed in a throat region (314) of the horn antenna extending in a direction aligned with the boresight axis (3100 of the antenna. The horn antenna is coupled to the shaped surface of revolution defining the subreflector.

23 Claims, 7 Drawing Sheets

SIMULTANEOUS MULTI-BAND RING FOCUS REFLECTOR ANTENNA-BROADBAND FEED

BACKGROUND OF THE INVENTION

1. Statement of the Technical Field

The invention concerns antenna systems, and more particularly ring focus antennas configured for concurrent multi-band operation.

2. Description of the Related Art

In recent years, there has arisen an increasing demand for microwave satellite communication antennas that have the ability to concurrently operate on multiple frequency bands. In those situations where a single coaxial feed for multiple bands is desired, it can be challenging to maintain existing system performance specifications.

U.S. Pat. No. 6,211,834 B1 to Durham et al. (hereinafter Durham), concerns a multi-band shaped ring focus antenna. In Durham, a pair of interchangeable, diversely shaped, close proximity-coupled sub-reflector-feed pairs are used for operation at respectively different spectral frequency bands. Swapping out the subreflector/feed pairs changes the operational band of the antenna. Accordingly, that system does not offer concurrent operation on spectrally offset frequency bands.

One approach to providing multi-band operation for a ring-focus antenna involves the use of coaxial antenna feeds. These types of feeds typically involve the placement of a first waveguide feed coaxially within a second waveguide feed. The second waveguide feed in some instances is a corrugated horn with a profiled taper. A corrugated horn antenna typically includes circumferential slots, or corrugations, along the interior walls of the antenna. Another advantage of the corrugated horn antenna is that it typically can be operated over a larger bandwidth as compared to a horn antenna having smooth walls. Still, these types of coaxial feeds using profiled horns are not suitable for all band combinations.

A second type of multi-band ring-focus feed is a hybrid horn system. These types of feeds also make use of a first horn positioned coaxially within a second horn. One unique feature of the hybrid horn feed system relates to the distinct way in which each of the first and second coaxial horns interact with a sub-reflector of the ring-focus antenna. In particular, the relative spacing between the outer coaxial horn and the sub-reflector can be selected to be less than about 1 wavelength. Positioned in this way, the sub-reflector is in the near field of the outer horn. The outer coaxial horn and the sub-reflector are said to operate in a coupled configuration. Conversely, the relative spacing between the inner coaxial horn and the sub-reflector can be more than about 8 wavelengths so that the sub-reflector is positioned in the far field relative to the inner horn. Accordingly, the inner coaxial horn and the sub-reflector are said to operate in a de-coupled configuration. These hybrid horn feeds for multi-band operation have been successful for some, but not all, band combinations.

Yet another solution that has been proposed for providing a multi-band ring-focus antenna involves the use of antennas that have co-located sub-reflectors or co-located main-reflectors. These designs have proven especially useful where it is desirable to utilize either an existing main reflector or where design requirements involve particularly complex frequency plans. However, designs for co-located sub-reflectors or co-located main reflectors usually involve frequency selective surfaces (FSS) and light weight materials. Accordingly, these types of systems can be relatively expensive to manufacture.

SUMMARY OF THE INVENTION

The invention concerns a compact multi-band antenna system that includes a main reflector having a shaped surface of revolution about a boresight axis of the antenna operable at a plurality of frequency bands spectrally offset from each other. For example, the shaped surface of revolution defining the main reflector and/or the subreflector can be shaped as a nonlinear surface of revolution. A multi band feed system is provided for the main reflector that includes a subreflector formed as a shaped surface of revolution about the boresight axis of the antenna, and a horn antenna. The horn antenna has one or more ridges disposed in a throat region of the horn antenna extending in a direction aligned with the boresight axis of the antenna. For example, a second ridge can be provided aligned with the boresight axis and opposed from the first ridge. Alternatively, the throat region of the horn antenna can include four of the ridges arranged around the boresight axis at equally spaced angular intervals.

The horn antenna described herein can be installed at a first location separated by a gap from a vertex of the subreflector on the boresight axis of the antenna. The gap can be advantageously selected to be less than four wavelengths at each of the spectrally offset frequency bands so that it operates in a coupled configuration with the subreflector. More particularly, the aperture of the horn antenna can be coupled to the shaped surface of revolution defining the subreflector. Consequently, the multiband feed system can define a focal ring for illuminating the main reflector at each of the plurality of frequency bands.

In an alternative embodiment, the invention can also include a method for feeding a ring focus antenna on two or more spectrally offset frequency bands. The method can include forming a first focal ring for a main reflector at a first frequency within a first one of the frequency bands using a horn antenna coupled to a subreflector of the ring focus antenna. The method can also include forming a second focal ring for the main reflector at a second frequency within a second one of the frequency bands using the horn antenna and the subreflector. Finally, the method can also include extending a bandwidth of the horn antenna by including at least a first ridge disposed in a throat region of the horn antenna extending in a direction aligned with the boresight axis of the antenna. For example, the horn antenna can be chosen to include four of the ridges disposed on a wall of the throat at equally spaced angular intervals about the boresight axis, and aligned with said boresight axis. According to one aspect, the invention can further include selecting at least one of the subreflector and the main reflector to be a shaped nonlinear surface of revolution about the boresight axis. Further, the horn antenna can be selected to have a circular polarization.

DETAILED DESCRIPTION OF THE INVENTION

Figure 1:
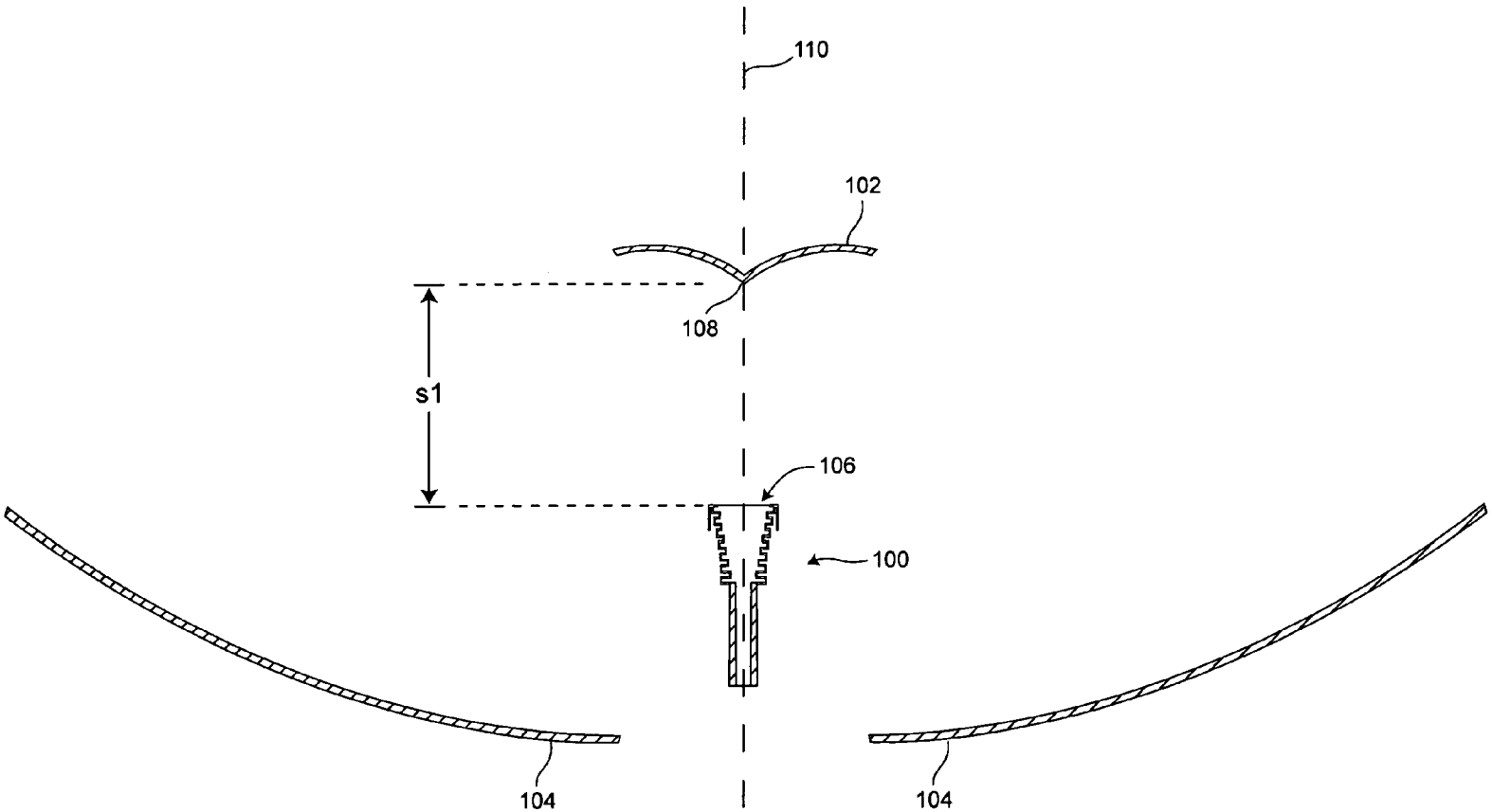
Fig. 1 Prior Art
FIG. 1 is a cross-sectional view of a decoupled ring-focus reflector antenna, taken along a boresight axis of the antenna, which is useful for understanding the invention.
Figure 2:
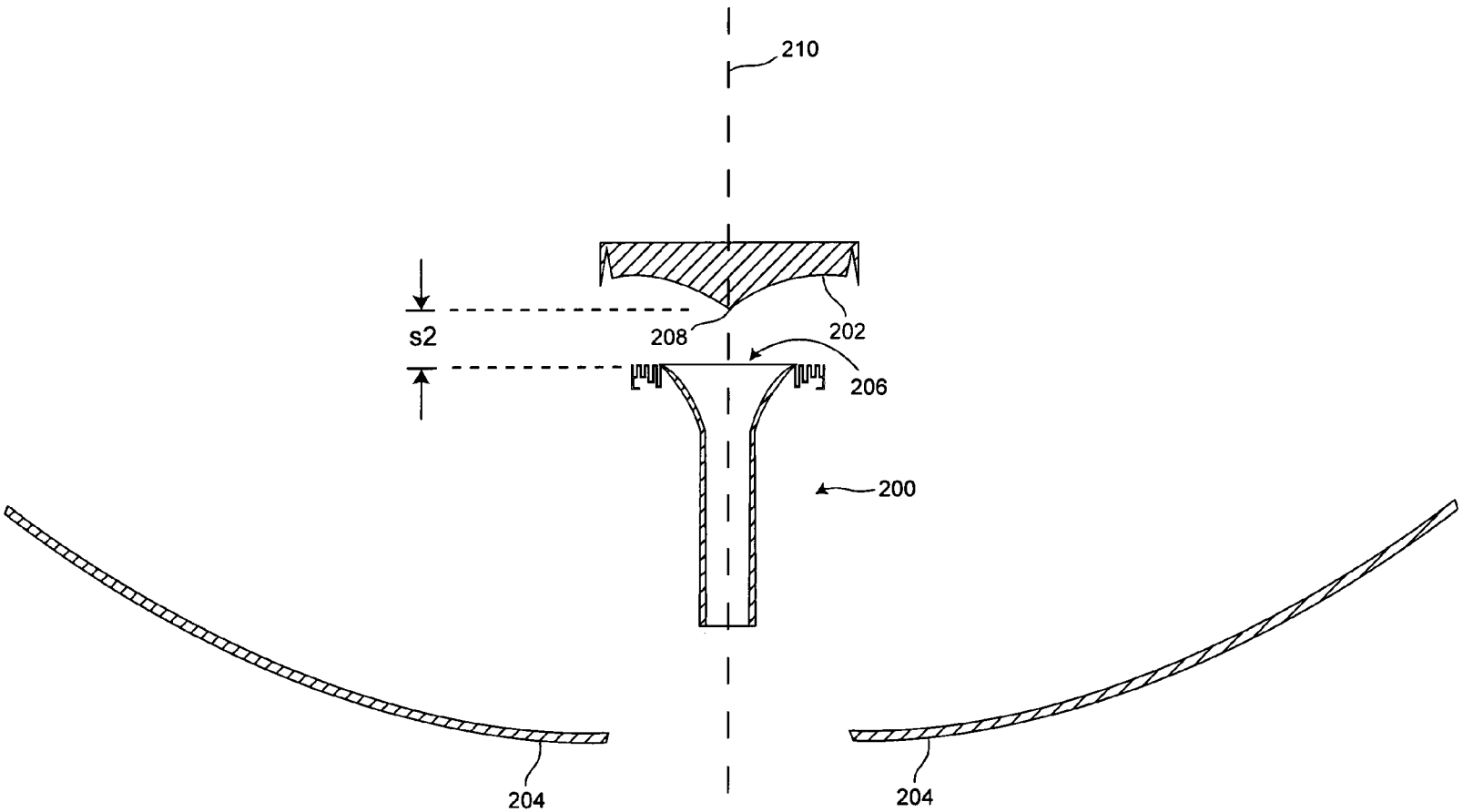
Fig. 2 Prior Art
FIG. 2 is a cross-sectional view of a coupled-feed ring-focus reflector antenna, taken along a boresight axis of the antenna, which is useful for understanding the invention.

Ring focus antenna architectures commonly make use of a dual reflector system as shown in FIGS. 1 and 2. With the dual reflector system, an RF feed 100 illuminates a sub-reflector 102, which in turn illuminates the main reflector 104. The RF feed 100 is typically a microwave horn antenna spaced from the subreflector. Sub-reflector 102 and main reflector 104 are shaped surfaces of revolution about a boresight axis 110 and are suitable for reflecting RF energy.

Typical Cassegrain and Gregorian type reflector systems commonly use feed horns and sub-reflectors arranged in accordance with a decoupled configuration. These are sometimes referred to as decoupled feed/subreflector antennas. In a decoupled feed/subreflector antenna, the RF feed 100 is located in the far field of the sub-reflector 102. For example, the aperture 106 of the RF feed 100 can be positioned spaced from a vertex 108 of the sub-reflector 102 by a distance at the frequency of interest, where s1 is greater than or equal to about four wavelengths. Since the RF feed is in the far-field, the decoupled feed/subreflector configuration lends itself to optical design techniques such as ray tracing, geometrical theory of diffraction (GTD) and so on.

A second known type of ring focus antenna system is disclosed in U.S. Pat. No. 6,831,613 to Gothard, et al. and illustrated in FIG. 2. This type of arrangement is known as a coupled-feed/sub-reflector antenna. Similar to the antenna in FIG. 1, this type of antenna makes use of a sub-reflector 202 and main reflector 204 that are shaped surfaces of revolution about a boresight axis 210 and are suitable for reflecting RF energy. However, in this type of antenna, the RF feed 200 and the sub-reflector 202 are spaced more closely as compared to the decoupled configuration. An aperture 206 of the RF feed and the vertex 208 of the sub-reflector 202 can be spaced apart by a distance s2 that is typically less than about 2 wavelengths at the frequency of interest. When arranged in this way, the RF feed 200 and the sub-reflector 202 are said to be coupled In the near-field to generate what is commonly known as a "back-fire" feed.

In a back-fire feed configuration, the RF feed 200 and the sub-reflector 202 in combination can be considered as forming a single integrated feed network. This single feed network is particularly noteworthy as it provides a circular to radial waveguide transition that generates a prime-ring-focus type feed for the main reflector 204. In this regard, the back-fire feed can be thought of as being similar to a prime-focus parabolic feed. Further, the sub-reflector 202 in this feed configuration is not truly operating as a reflector in the conventional sense but rather as a splash-plate directly interacting with the feed aperture 206.

The ring focus antenna in FIG. 2 can employ a shaped-geometry main reflector and a shaped-geometry sub-reflector feed similar to the arrangement described in U.S. Pat. No. 6,211,834 B1 to Durham et al., the disclosure of which is incorporated herein by reference. In Durham et al., interchangeable, diversely shaped close proximity-coupled sub-reflector/feed pairs are used with a single multi-band main reflector for operation at respectively different spectral frequency bands. Swapping out the sub-reflector/feed pairs changes the operational band of the antenna. Each of the main reflector and the sub-reflector in the system described in Durham et al. are respectively shaped as a distorted or non-regular paraboloid and a distorted or non-regular ellipsoid.

Figure 3:
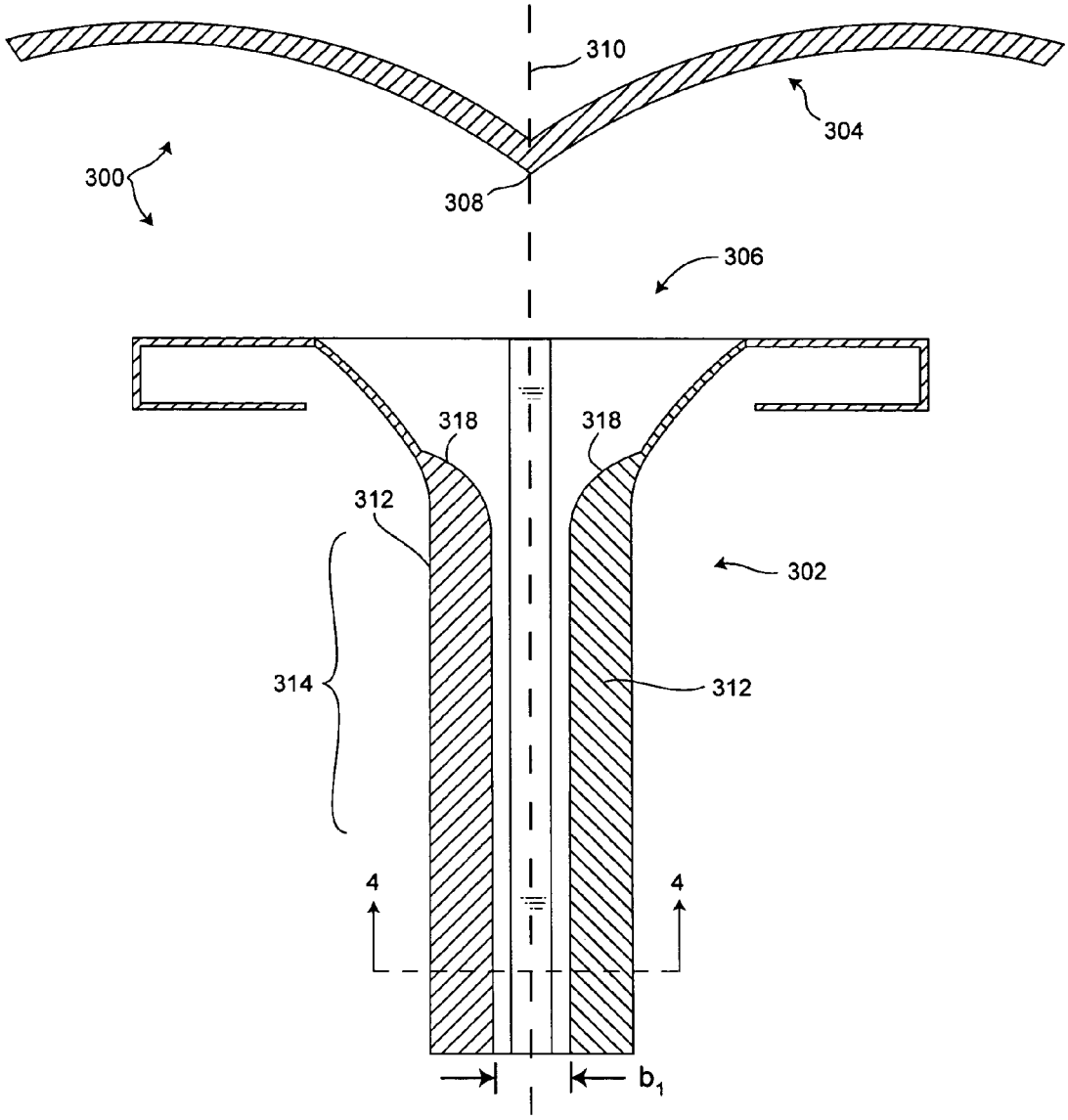
FIG. 3 is a cross-sectional view of a multiband ring focus antenna feed system, taken along a boresight axis of the antenna, which is useful for understanding the invention.

Referring now to FIG. 3, there is shown a cross-sectional view of a broad band feed assembly 300 that is useful for understanding the present invention. The broadband feed assembly 300 can include an RF feed horn 302 and a subreflector 304. Broadband feed assembly 300 is a coupled-feed, meaning that the aperture 306 of the RF feed horn 302 directly interacts with the sub-reflector 304. The sub-reflector 304 can be a shaped surface of revolution about a boresight axis 310 and is suitable for reflecting RF energy.

An aperture 306 of the RF feed horn 302 and the vertex 308 of the sub-reflector 304 can be spaced apart by a distance that is less than about 4 wavelengths. For example, the spacing can be less than about 2 wavelengths at an operating frequency of interest. In any case, the RF feed 302 and the sub-reflector 304 are coupled in the near-field to generate what is commonly known as a "back-fire" feed.

Figure 4:
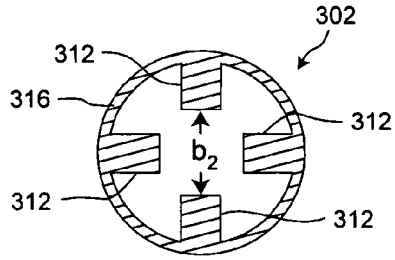
FIG. 4 is a cross-sectional view of the multiband ring focus antenna feed system of FIG. 3, taken along line 4—4.

The RF feed horn 302 preferably has a circular cross-section as shown in FIG. 4. Accordingly, RF energy propagating within the feed horn 302 and transmitted toward the subreflector 304 can be circularly polarized.

One or more elongated ridges 312 can be disposed within at least a waveguide portion of the horn antenna. For example, a set of four ridges 312 can be disposed in a throat region 314 of the horn antenna 302. These four ridges can extend along a length of the horn, toward the aperture 306, in a direction generally aligned with the boresight axis 310. The ridges 312 can be positioned on an inner surface of wall 316 at equally spaced angular intervals around the boresight axis 310. For example, the ridges can be located at 0, 90, 180, and 270 degree angular orientations as shown in FIG. 4. Finally, each of the ridges can have a tapered portion 318 to decrease the height of the ridge as it approaches the aperture 306. According to a preferred arrangement, the tapered section should terminate within the throat region 314 of the horn antenna 302 and should not extend into the aperture region where the horn is flared outwardly.

The bandwidth of the throat region of a horn antenna is generally the difference between the cutoff frequency of the dominant mode of the waveguide ($TE_{11}$ for a circular waveguide as shown in FIG. 4) and the cutoff of the next-highest order mode which will be excited by the geometry of the waveguide. This bandwidth can be increased by providing ridges 312 as shown in FIGS. 3 and 4. The ridges reduce the cutoff frequency of the $TE_{11}$ mode.

More particularly, ridges 312 can form a parallel plate waveguide within the cylindrical waveguide. The parallel plate waveguide propagates a TEM mode. As the gaps b1 and b2 between the ridges is narrowed, the cutoff frequency of the $TE_{11}$ mode decreases towards zero frequency. The performance of ridge loaded waveguides can be predicted using basic RF transmission line techniques. Using these techniques, the dimensions of the ridges can be calculated to provide desired characteristic impedance and return loss over selected frequency bands of interest. In general, however, the widest bandwidth for the horn 302 will be achieved when the spacings b1 and b2 are small relative to the diameter of the cylindrical waveguide forming throat 314.

Referring once again to FIG. 3, the exact curvature of the tapered portion 318 is not critical but is advantageously selected to provide a smooth change in impedance along the length of the horn 302. For example, an exponential taper can be used for this purpose, as is well known in the art of waveguide tapers. The taper defined by tapered portion 318 can also be linear or parabolic in shape. Still, the invention is not limited in this regard, and other tapered profiles are also possible.

Finally, it may be observed in FIG. 3 that the aperture of the horn antenna is spaced relatively closely to the vertex 308 of the subreflector 304. In general, this distance will be less than about four wavelengths. Calculation of the exact spacing can be accomplished using a technique that is described below in further detail.

In order to facilitate the use of sub-reflector 304 and main reflector 502 concurrently on the two or more separate frequency bands, each is advantageously shaped so as to have no continuous surface portion thereof shaped as a regular conical surface of revolution. Consequently, the precise shape of the main reflector 502 and the sub-reflector 304 can be determined based upon computer analysis.

More particularly, a computer program can be used to determine suitable shapes for the sub-reflector 304 and the main reflector 502. This process generates a numerically defined dual reflector system as shown and described relative to FIG. 5. The resulting shape of the main reflector is a conical surface of revolution that is generally, but not necessarily precisely, parabolic. The resulting shape of the sub-reflector is likewise a conical surface of revolution that is generally, but not necessarily precisely, elliptical.

Figure 5:
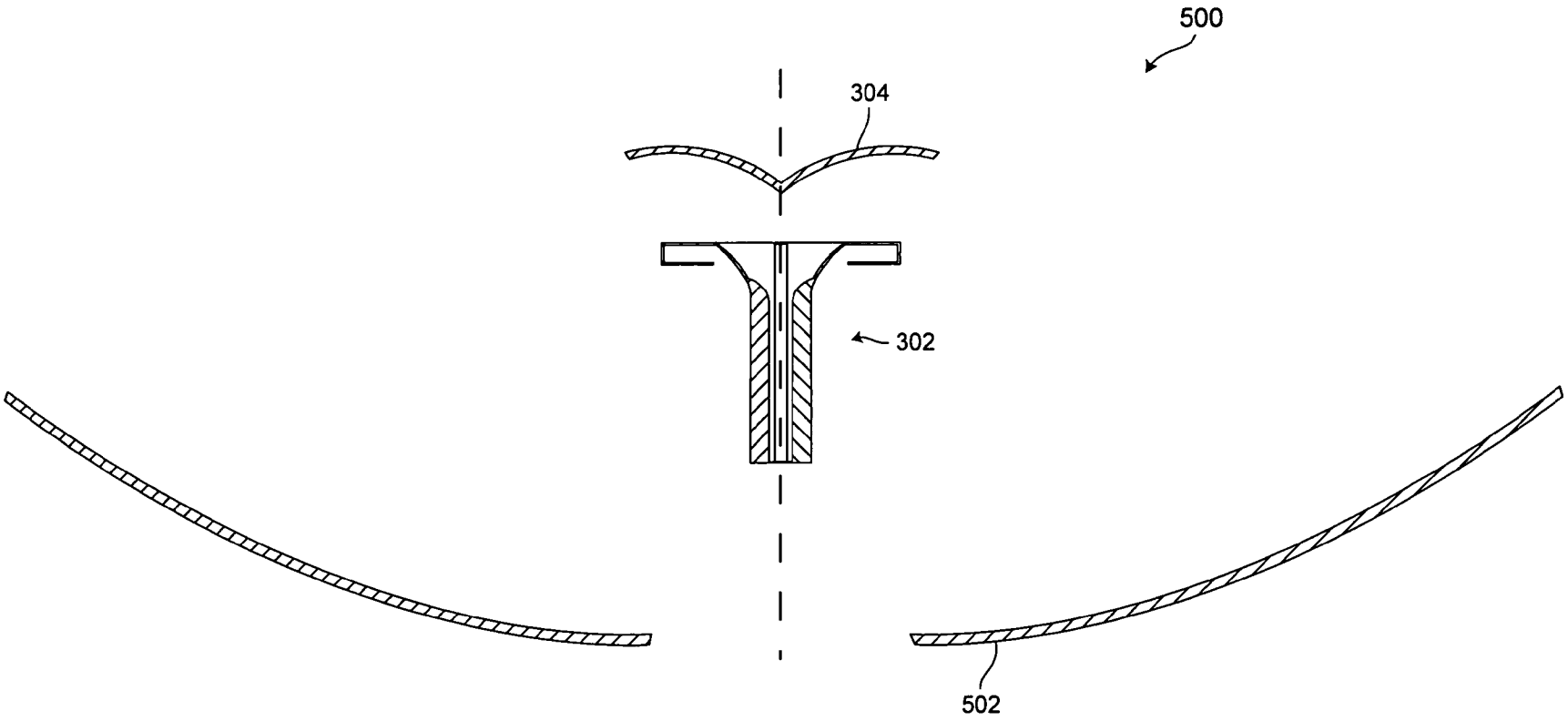
FIG. 5 is a cross-sectional view of a multiband ring focus antenna incorporating the feed system of FIGS. 3 and 4.

The main reflector 502 and the sub-reflector 304 are typically shaped non-linear surfaces of revolution. In general, the shape of the main reflector and the sub-reflector in FIGS. 3–5 are not definable by an equation as would normally be possible in the case of a regular conic, such as a parabola or an ellipse. Instead, the shapes are generated by executing a computer program that solves a prescribed set of equations for certain pre-defined constraints.

The term 'shaped' as used herein refers to a subreflector and main reflector geometry that is defined in accordance with a prescribed set of (reduced sidelobe envelope) directivity pattern relationships and boundary conditions for a prescribed set of equations, rather than a shape that is definable by an equation for a regular conic, such as a parabola or an ellipse. Boundary conditions can include main reflector and sub-reflector diameters and the feed phase center. Given prescribed feed inputs to and boundary conditions for the antenna, the shape of each of a subreflector and a main reflector are generated by executing a computer program that solves a prescribed set of equations for the predefined constraints. In a preferred embodiment, the equations are those which: 1—achieve conservation of energy across the antenna aperture, 2—provide equal phase across the antenna aperture, and 3—obey Snell's law. Details of the foregoing process are discussed in U.S. Pat. No. 6,211,834 to Durham et al, the disclosure of which is incorporated herein by reference.

While the boundary conditions may be selected to define a regular conical shape, such is not the intent of the shaping of the invention. The ultimate shape of the subreflector and the main reflector are whatever the parameters of the operational specification of the antenna dictate, when applied to the directivity pattern relationships and boundary conditions.

Once the shapes of a subreflector and main reflector pair have been generated, the performance of the antenna can be subjected to computer analysis, to determine whether the generated antenna shapes will produce a desired directivity characteristic. If the design performance criteria are not initially satisfied, one or more of the parameter constraints can be adjusted, and performance of the antenna can be analyzed for the new set of shapes. This process can be repeated iteratively, until the shaped pair meets the antenna's intended operational performance specification.

Figure 6:
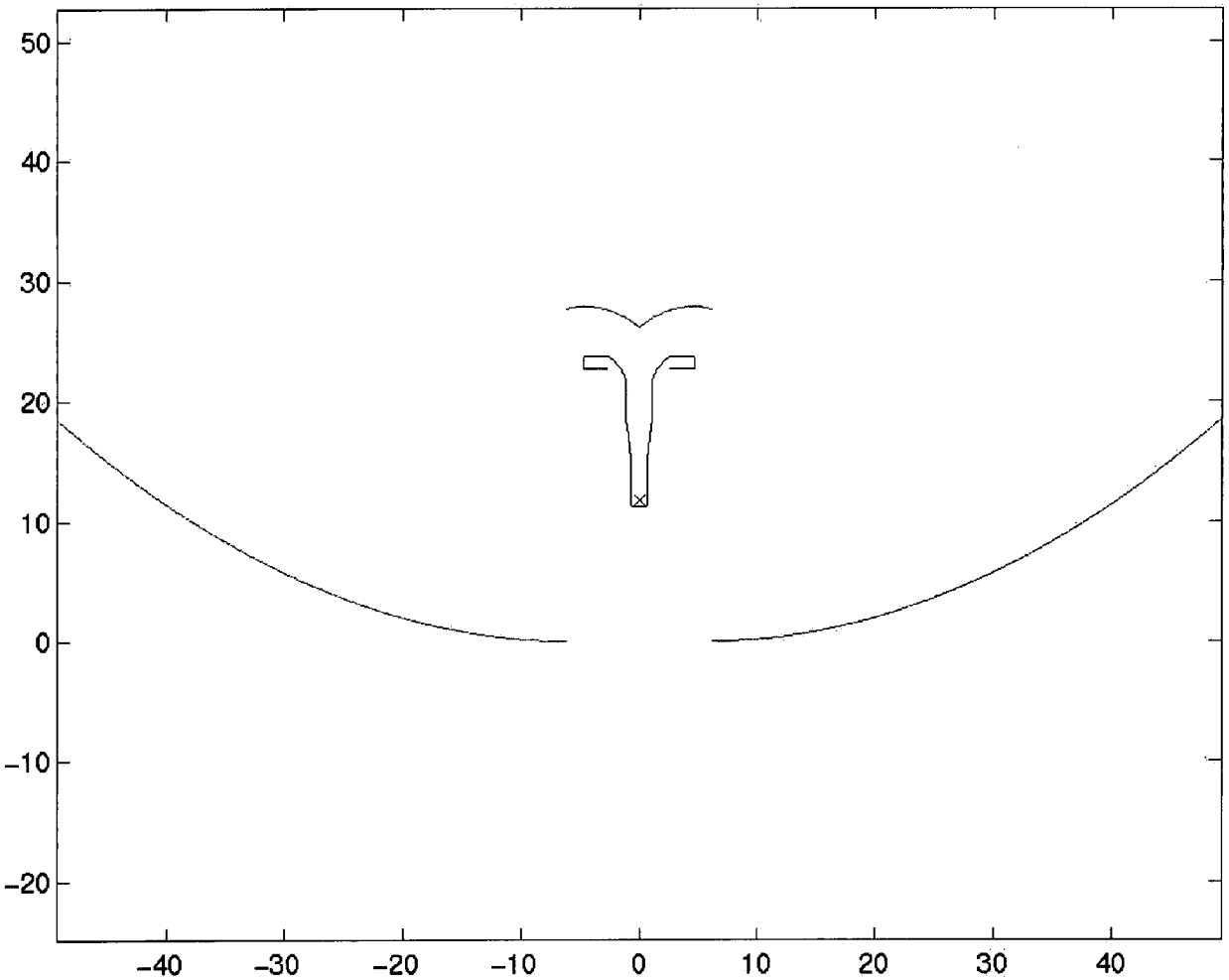
FIG. 6 is a schematic representation of an example antenna geometry that is useful for understanding the inventive arrangements.

For example, by utilizing the foregoing techniques, it is possible to obtain the geometry illustrated in FIG. 6, which is defined by the following parameters:

Main Reflector Diameter=98.4 inches

Subreflector Diameter=12.4 inches

Distance subreflector vertex to zero reference of main reflector=26.1 inches

Distance subreflector vertex to aperture of horn=2.4 inches

Figure 7:
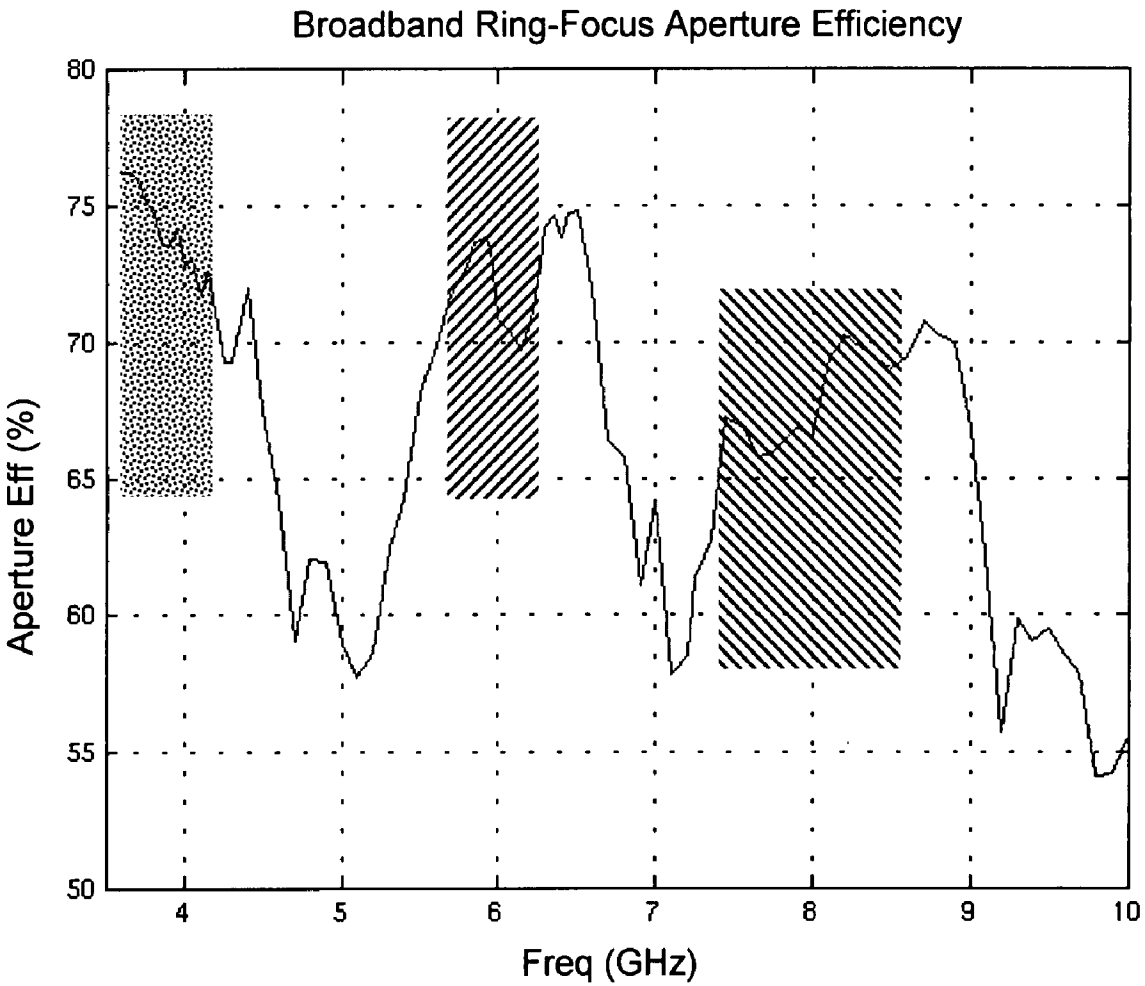
FIG. 7 is a plot of aperture efficiency versus frequency for a broadband ring-focus antenna utilizing the broadband feed system of FIG. 6.
Figure 8:
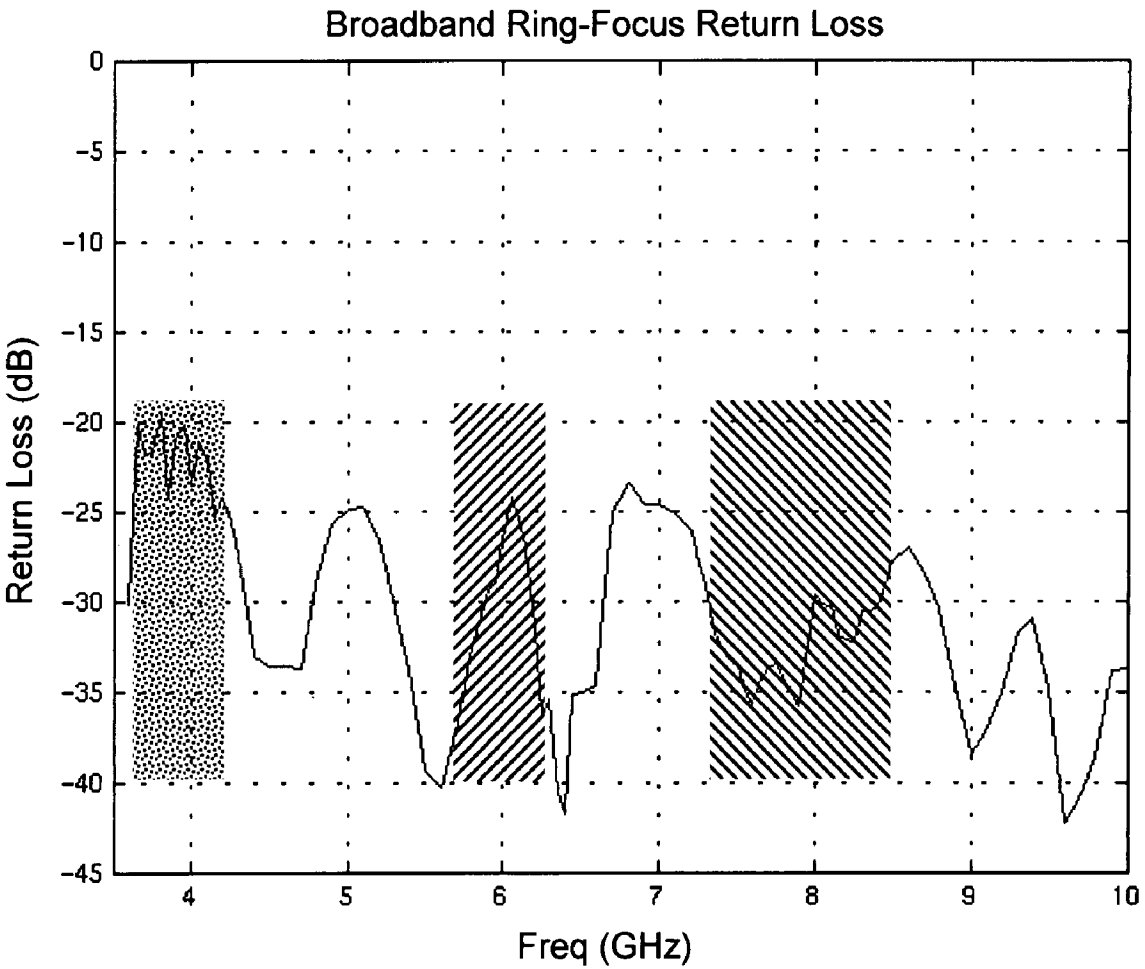
FIG. 8 is a plot of return loss versus frequency for a broadband ring-focus antenna utilizing the broadband feed system of FIG. 6.

With the foregoing dimensions, and using the computational techniques described above, an antenna with an operational frequency range from 3.5 GHz to 10 GHz can be achieved. FIGS. 7 and 8 are plots of return loss and aperture efficiency obtained by computer modeling with respect to the antenna shown in FIG. 6.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims. For example, it should be noted that while the antennas described herein have for convenience been largely described relative to a transmitting mode of operation, the invention is not intended to be so limited. Those skilled in the art will readily appreciate that the antennas can be used for receiving as well as transmitting.

We claim:

1. A compact multi-band antenna system comprising:

a main reflector having a shaped surface of revolution about a boresight axis of said antenna and being concurrently operable at a plurality of frequency bands spectrally offset from each other;

a multi band feed system for said main reflector comprising a subreflector formed as a shaped surface of revolution about said boresight axis of said antenna, and a horn antenna having at least a first ridge disposed in a throat region of said horn antenna extending in a direction aligned with said boresight axis; and wherein said shaped surface of revolution defining at least one of said main reflector and said subreflector is exclusive of any continuous surface portion shaped as a regular conical surface of revolution.

2. The compact multi-band antenna system according to claim 1, further comprising at least a second ridge aligned with said boresight axis and opposed from said first ridge.

3. The compact multi-band antenna system according to claim 1, wherein said horn antenna has a circular polarization and said throat includes four of said ridges arranged around said boresight axis at equally spaced angular intervals.

4. The compact multi-band antenna system according to claim 1, wherein said horn antenna is installed at a first location separated by a gap from a vertex of said subreflector on said boresight axis of said antenna.

5. The compact multiband antenna system according to claim 4, wherein said gap is less than four wavelengths at each of said spectrally offset frequency bands.

6. The compact multi-band antenna system according to claim 5, wherein said subreflector has a shape that defines a focal ring for illuminating said main reflector at each of said plurality of frequency bands.

7. The compact multi-band antenna system according to claim 4, wherein said horn antenna is coupled to said shaped surface of revolution defining said subreflector.

8. The compact multi-band antenna system according to claim 7, wherein said subreflector has a shape that defines a focal ring for concurrently illuminating said main reflector at each of said plurality of frequency bands.

9. The compact multi-band antenna system according to claim 1, wherein said horn antenna is coupled to said subreflector and said subreflector has a shape that defines a focal ring for concurrently illuminating said main reflector at each of said plurality of frequency bands.

10. The compact multi-band antenna system according to claim 1, wherein said horn antenna has a circular polarization and said throat includes four of said ridges arranged around said boresight axis at equally spaced angular intervals, said horn antenna coupled to said subreflector to form a multiband feed system that defines a focal ring for concurrently illuminating said main reflector at said plurality of frequency bands.

11. The compact multiband antenna system according to claim 1, wherein said shaped surface of revolution defining at least one of said main reflector and said subreflector is a nonlinear surface of revolution.

12. A method for concurrently illuminating a main reflector of a multiband ring focus reflector antenna on a plurality of spectrally offset frequency bands, comprising:

forming a first focal ring for said main reflector at a first frequency within a first one of said frequency bands using a horn antenna and a subreflector formed as a shaped surface of revolution about a boresight axis of said antenna;

selecting said shaped surface of revolution to be exclusive of any continuous surface portion shaped as a regular conical surface of revolution;

coupling an aperture of said horn antenna to said subreflector by positioning said aperture a predetermined distance apart from a vertex of said subreflector along said boresight axis;

concurrently with forming said first focal ring, forming a second focal ring for said main reflector at a second frequency within a second one of said frequency bands using said horn antenna and said subreflector; and providing a horn antenna bandwidth sufficient to include said first and second frequency bands by selecting said horn antenna to include at least a first ridge disposed in a throat region of said horn antenna and extending in a direction aligned with said boresight axis.

13. The method according to claim 12, further comprising selecting said horn antenna to include at least a second ridge opposed from said first ridge.

14. The method according to claim 12, further comprising generating RF with circular polarization using said horn antenna.

15. The method according to claim 12 further comprising selecting said throat to include four of said ridges arranged around said boresight axis at equally spaced angular intervals.

16. The method according to claim 12, further comprising the step of selecting said predetermined distance to be less than four wavelengths at a frequency within each of said first and second frequency bands.

17. The method according to claim 12, further comprising the step of selecting said shaped surface of revolution to be a nonlinear surface of revolution.

18. The method according to claim 12, further comprising the step of selecting said main reflector to be a nonlinear surface of revolution about said boresight axis.

19. A method for concurrently feeding a ring focus antenna on a plurality of spectrally offset frequency bands, comprising:

forming a first focal ring for a main reflector at a first frequency within a first one of said frequency bands using a horn antenna coupled to a subreflector of said ring focus antenna;

concurrent with forming said first focal ring, forming a second focal ring for said main reflector at a second frequency within a second one of said frequency bands using said horn antenna and said subreflector;

selecting at least one of said subreflector and said main reflector to be exclusive of any continuous surface portion shaped as a regular conical surface of revolution; and extending a bandwidth of said horn antenna by including at least a first ridge disposed in a throat region of said horn antenna and extending in a direction aligned with said boresight axis.

20. The method according to claim 19, further comprising selecting at least one of said subreflector and said main reflector to be a shaped nonlinear surface of revolution about said boresight axis.

21. The method according to claim 19, further comprising the step of selecting said horn antenna to have a circular polarization.

22. The method according to claim 21, further comprising the step of selecting said horn antenna to include four of said ridges disposed on a wall of said throat at equally spaced angular intervals about said boresight axis.

23. The method according to claim 19, further comprising the step of selecting said at least one ridge to extend from said throat toward an aperture of said horn.

* * * * *